US008701856B2

(12) United States Patent
Tomisaki

(10) Patent No.: US 8,701,856 B2
(45) Date of Patent: Apr. 22, 2014

(54) LOADING DEVICE

(75) Inventor: Shin Tomisaki, Kitakyusyu (JP)

(73) Assignee: Nippon Steel Engineering Co., Ltd., Tokyo (JP)

( * ) Notice: Subject to any disclaimer, the term of this patent is extended or adjusted under 35 U.S.C. 154(b) by 0 days.

(21) Appl. No.: 13/377,059

(22) PCT Filed: Oct. 8, 2010

(86) PCT No.: PCT/JP2010/067718

§ 371 (c)(1),
(2), (4) Date: Dec. 8, 2011

(87) PCT Pub. No.: WO2011/043454

PCT Pub. Date: Apr. 14, 2011

(65) Prior Publication Data

US 2012/0181140 A1 Jul. 19, 2012

(30) Foreign Application Priority Data

Oct. 9, 2009 (JP) ..... 2009-234957

(51) Int. Cl.
*B65G 11/00* (2006.01)

(52) U.S. Cl.
USPC ..... 193/16; 414/301

(58) Field of Classification Search
None
See application file for complete search history.

(56) References Cited

U.S. PATENT DOCUMENTS

| | | | | |
|---|---|---|---|---|
| 3,814,403 A | | 6/1974 | Legille | |
| 4,547,116 A | * | 10/1985 | Legille et al. | 414/160 |
| 5,799,777 A | * | 9/1998 | Mailliet et al. | 198/642 |
| 6,390,268 B1 | * | 5/2002 | Lonardi | 193/16 |
| 6,580,744 B1 | * | 6/2003 | Irnich | 373/79 |
| 7,311,486 B2 | * | 12/2007 | Gorza et al. | 414/301 |
| 2005/0063804 A1 | * | 3/2005 | Gorza et al. | 414/301 |
| 2012/0070253 A1 | * | 3/2012 | Thillen et al. | 414/199 |

FOREIGN PATENT DOCUMENTS

| | | |
|---|---|---|
| CN | 85 1 09284 A | 4/1987 |
| CN | 87 1 01645 A | 2/1988 |
| CN | 1039650 A | 2/1990 |

(Continued)

OTHER PUBLICATIONS

International Search Report issued in International Patent Application No. PCT/JP2010/067718 dated Dec. 14, 2010.

(Continued)

*Primary Examiner* — Ramya Burgess
*Assistant Examiner* — Thomas Randazzo
(74) *Attorney, Agent, or Firm* — Oliff PLC

(57) ABSTRACT

A charging device capable of moving a distribution chute with a simple structure and easy control is provided. The charging device includes: a frame; a rotation axis set in the frame; a rotor supported by the frame and being rotatable around the rotation axis; an adjustment axis set in the rotor and intersecting with the rotation axis at a first angle; a holder supported by the rotor and being rotatable around the adjustment axis; a distribution chute fixed to the holder and extending in a direction intersecting with the adjustment axis at a second angle; a rotation drive motor fixed to the frame and rotating the rotor against the frame; a transmission-side bevel gear supported by the frame and being rotatable around the rotation axis; a holder-side bevel gear fixed to the holder and being meshed with the transmission-side bevel gear; and an adjustment drive motor fixed to the frame and rotating the holder against the rotor by rotating the transmission-side bevel gear.

6 Claims, 16 Drawing Sheets

(56) References Cited

FOREIGN PATENT DOCUMENTS

| | | | |
|---|---|---|---|
| CN | 1135773 | A | 11/1996 |
| CN | 1141654 | A | 1/1997 |
| EP | 1 218 550 | B1 | 5/2003 |
| JP | A-49-41205 | | 4/1974 |
| JP | A-09-508442 | | 8/1997 |
| JP | A-2005-511454 | | 4/2005 |
| JP | A-2008-521723 | | 6/2008 |
| WO | WO 03/050314 | A1 | 6/2003 |

OTHER PUBLICATIONS

May 15, 2012 International Preliminary Report on Patentability issued in International Application No. PCT/JP2010/067718.
Sep. 29, 2013 Office Action issued in Chinese Patent Application No. 201080032897.6 (with partial English-language translation).

* cited by examiner

LOADING DEVICE

TECHNICAL FIELD

The invention relates to a charging device, for distributing material into a vessel such as a blast furnace.

BACKGROUND ART

Such charging devices have been used as a device for distributing material into blast furnaces for producing iron. Such charging devices have also been used for filling material into other vessels such as reacting furnaces, reaction towers and catalyst containers.

In such a charging device, it is necessary to distribute the material in a desired pattern, such as an even planar distribution inside a vessel. For this purpose, the charging device is required to be able to freely control the direction and the condition of the charged material. For this purpose, various distribution mechanisms have been developed.

In the device of Patent Literature 1, a cylindrical or drain-pipe shaped distribution chute is installed in an inclined manner. By rotating the distribution chute around a vertical rotation axis, the material is distributed inside the blast furnace in a ring shape through a tip of the distribution chute. Further, by adjusting the angle of inclination of the distribution chute relative to the rotation axis, the area in which the material discharged from the distribution chute reaches is changed, thereby controlling the state of the distribution.

The device of Patent Literature 2 similarly controls the state of the distribution by rotating a distribution chute as described above. However, the device does not have mechanism to rotate the distribution chute around the rotation axis. Instead the rotation function is achieved by the swing actions of two pivot mechanisms. Accordingly, the two pivot support mechanisms of the distribution chute are installed in a manner that the pivot axes of the respective pivot support mechanisms intersect with each other and two drive cylinders corresponding to each direction are cooperatively operated.

CITATION LIST

Patent Literatures

Patent Literature 1: JP-A-49-41205
Patent Literature 2: JP-T-2008-521723

SUMMARY OF INVENTION

Problems to be Solved by the Invention

The above-described Patent Document 1 entails the following problems.

The mechanism and the driving source for inclining the distribution chute must be rotated uniformly. Accordingly, the structure such as the rotating portion becomes complicated and the cost for the equipment increases. Further, maintenance for keeping such a complicated mechanism rotating is troublesome.

On the other hand, the above-described Patent Document 2 entails the following problems.

Since the two pivot mechanisms must be cooperatively operated, the operation is complicated and it is difficult to increase the accuracy of the distribution of the material.

An object of the invention is to provide a charging device capable of moving a distribution chute with a simple structure and accurate control.

Means for Solving the Problems

A charging device according to an aspect of the invention includes: a frame; a rotation axis set in the frame; a rotor supported by the frame and being rotatable around the rotation axis; an adjustment axis set in the rotor and intersecting with the rotation axis at a first angle; a holder supported by the rotor and being rotatable around the adjustment axis; a distribution chute fixed to the holder and extending in a direction intersecting with the adjustment axis at a second angle; a rotation drive motor fixed to the frame and rotating the rotor against the frame around the rotation axis; a transmission-side bevel gear supported by the frame and being rotatable around the rotation axis; a holder-side bevel gear fixed to the holder and being meshed with the transmission-side bevel gear; and an adjustment drive motor fixed to the frame and rotating the holder against the rotor by rotating the transmission-side bevel gear.

The charging device according to the above aspect of the invention may be arranged such that the rotation drive motor rotates the rotor through a transmission path such as a gear train and the adjustment drive motor rotates the transmission-side bevel gear through a transmission path such as a gear train. Alternatively, as the device of Patent Literature 1, the charging device according to the above aspect of the invention may be arranged such that the rotation drive motor rotates the rotor through a transmission mechanism such as a gear train and rotates the transmission-side bevel gear through a gear train including a planetary gear, and the adjustment drive motor rotates the transmission-side bevel gear through a transmission path including a planetary gear.

In the above aspect of the invention, the frame supports the rotor, the rotor supports the holder, and the distribution chute is fixed to the holder. The rotation drive motor rotates the rotor around the rotation axis. The adjustment drive motor rotates the holder against the rotor and adjusts the angle of inclination of the distribution chute relative to the rotation axis.

In other words, since the adjustment axis intersects with the rotation axis at the first angle and the distribution chute intersects with the adjustment axis at the second angle, when the holder and the rotor are relatively rotated, the angle of inclination of the distribution chute relative to the rotation axis changes in a range from a difference (a minimum value) between the first angle and the second angle to a sum (a maximum value) of the first angle and the second angle. As a result, the angle of the distribution chute relative to the frame and rotor can be selected in a range from the maximum value to the minimum value, as needed.

In the aspect of the invention, the holder-side bevel gear and the transmission-side bevel gear are constantly meshed with each other even when the rotor is rotating around the rotation axis. By rotating the transmission-side bevel gear around the rotation axis, the holder can be rotated around the adjustment axis against the rotor. Since the transmission-side bevel gear rotates around the rotation axis, the driving force can be transmitted from the adjustment drive motor fixed to the frame through a transmission path such as a gear train.

In the aspect of the invention, the control method for adjusting the angle of inclination of the distribution chute depends on how the rotation drive motor and adjustment drive motor are arranged.

When the rotation drive motor rotates the rotor independently and the adjustment drive motor rotates the transmission-side bevel gear independently, in other words, when the driving of the rotor by the rotation drive motor and the driving of the transmission-side bevel gear by the adjustment drive motor are independent from each other, the rotation speed of the adjustment drive motor is controlled based on the rotation speed of the rotation drive motor as an input value.

In the normal occasion, by controlling the rotation speed of the rotor and the transmission-side bevel gear to the same rotation speed, the rotor, the holder and the distribution chute will be rotated with a constant angle of inclination of the distribution chute. On the other hand, in the occasion of adjustment, by controlling the rotation speed of the adjustment drive motor so that the rotor and the transmission-side bevel gear rotate at different rotation speeds, the phase of the transmission side bevel gear relative to the rotor is altered and a driving force is transmitted to the holder-side bevel gear to rotate the holder around the adjustment axis against the rotor, and the angle of inclination of the distribution chute relative to the rotation axis changes.

The charging device according to the aspect of the invention may be arranged such that the rotation drive motor rotates the rotor and also rotates the transmission-side bevel gear through the gear train including the planetary gear while the adjustment drive motor also rotates the transmission-side bevel gear through the gear train including the planetary gear.

In the aspect of the invention, in the normal occasion, the rotor and the transmission-side bevel gear are synchronously rotated by the rotation drive motor. On the other hand, in the occasion of adjustment, by activating the adjustment drive motor, the rotation speed of the transmission-side bevel gear is accelerated or decelerated through the planetary gear and the phase of the transmission-side bevel gear relative to the rotor is changed. Thus, a driving force is transmitted to the holder-side bevel gear and the holder rotates around the adjustment axis against the rotor, and the angle of inclination of the distribution chute relative to the rotation axis is changed.

Thus, in the aspect of the invention, the basic distribution movement is performed when the rotation drive motor rotates the distribution chute. Also by adjusting the phase between the rotor and the transmission-side bevel gear with the adjustment drive motor, the angle of inclination of the distribution chute relative to the rotation axis, i.e., the angle of the holder and distribution chute relative to the frame and rotor, can be adjusted, whereby the radius of the ring in which the material is distributed can be adjusted.

In the aspect of the invention, since the angle of the distribution chute can be adjusted while continuing the basic rotation, the control of the device is greatly simplified. Moreover, the rotor, the holder, the support structure and the transmission path from the rotation drive motor to the rotor are a functionally simple structure, thereby avoiding complications of the mechanism. The transmission path from the adjustment drive motor to the holder is also provided in a simple manner using the above-described bevel gear, thereby avoiding complications of the mechanism.

In the charging device according to the above aspect of the invention, it is desirable that the first angle is equal to the second angle.

With this arrangement, as described above, the angle of inclination of the center axis of the distribution chute relative to the rotation axis changes in a range from the difference (the minimum value) between the first angle and the second angle to the sum (the maximum value) of the first angle and the second angle. Accordingly, by equalizing the first angle and the second angle, the minimum value relative to the rotation axis becomes 0 degree (the center axis of the distribution chute will point vertically downward).

In the charging device according to the aspect of the invention, when an angle formed by the center axis of the distribution chute and an inner surface of the distribution chute is defined as a third angle, it is desirable that a sum of the first angle, the second angle and the third angle is set at the maximum inclination angle required for the distribution chute.

With this arrangement, as described above, the angle of inclination of the distribution chute relative to the rotation axis changes in a range from the difference (the minimum value) between the first angle and the second angle to the sum (the maximum value) of the first angle, the second angle and the third angle. Accordingly, the maximum value defined as the sum of the first angle, the second angle and the third angle can be set according to the maximum inclination angle required for the distribution chute.

DESCRIPTION OF EXEMPLARY EMBODIMENT

An exemplary embodiment of the invention will be described below with reference to the attached drawings.

Figure 1:
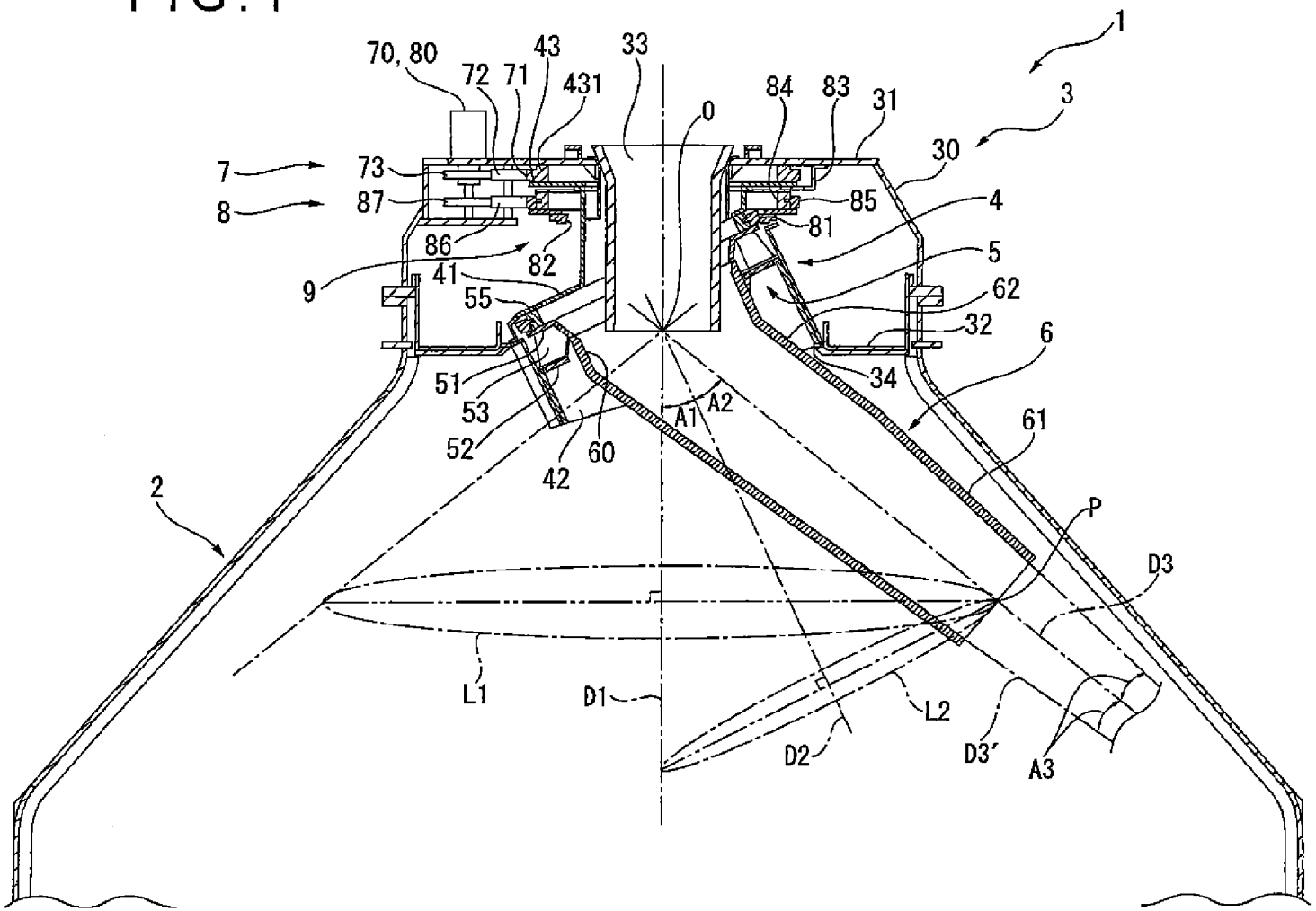
FIG. 1 is a vertical cross-sectional view showing an exemplary embodiment of the invention.
Figure 2:
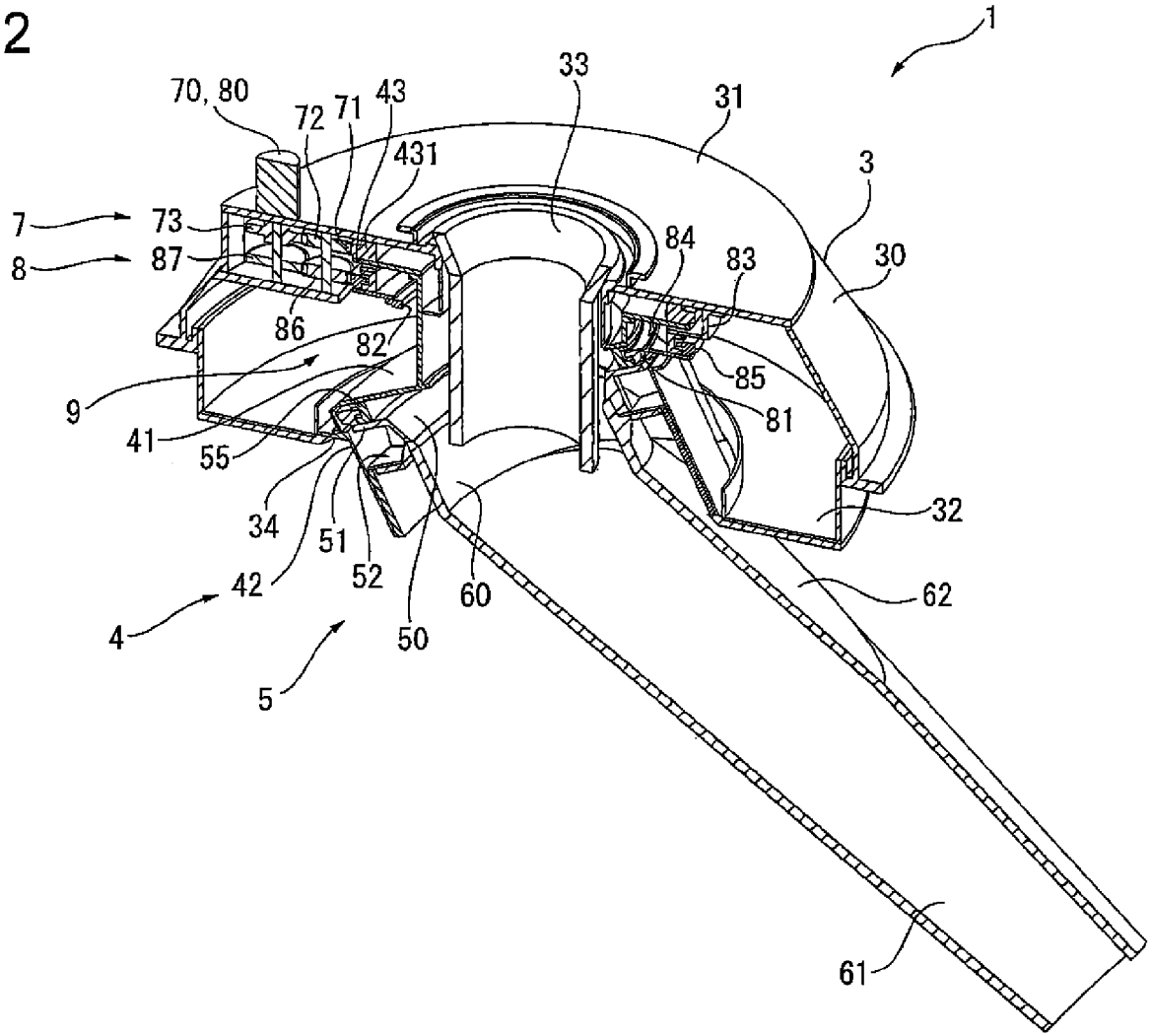
FIG. 2 is a partially cut-away perspective view showing the above exemplary embodiment.

In FIGS. 1 and 2, a charging device 1 of this exemplary embodiment is placed on the top of a blast furnace 2 and distributes material, such as iron ores and coal, into the blast furnace.

The top of the blast furnace 2 is a circular truncated cone shape. A frame 3 is placed on the upper opening of the top of the blast furnace. The frame 3 supports a rotor 4. The rotor 4 supports a holder 5. The holder 5 supports a distribution chute 6.

In the charging device 1 of the exemplary embodiment, a rotation axis D1, an adjustment axis D2, and a distribution chute center axis D3 are set. The frame 3, rotor 4, holder 5 and distribution chute 6 are respectively positioned according to the three axes.

The rotation axis D1 is a vertical axis and coincides with the center axis of the blast furnace 2.

The adjustment axis D2 intersects with the rotation axis D1 at an intersection point O, where an intersection angle therebetween is defined as a first angle A1.

The distribution chute center axis D3 intersects with the adjustment axis D2 at the intersection point O, where an intersection angle therebetween is defined as a second angle A2.

The distribution chute center axis D3 defines a direction in which the material is distributed from the distribution chute 6 into the blast furnace. The direction is typically the direction of the bottom of the distribution chute 6 shaped in a circular truncated cone.

In this exemplary embodiment, the shape of the distribution chute 6 is basically a circular truncated cone with the distribution chute center axis D3 as the center axis with an inclination of angle A3. Since an upper part of a base of the distribution chute 6 (i.e., a part with a large diameter supported by the holder 5) does not define the distribution direction of the material, the circular truncated cone shape is partially cut off so as not to interfere with the frame 3. Accordingly, in the exemplary embodiment, the direction in which the material is distributed from the distribution chute 6, is the direction of the bottom of the distribution chute 6, i.e., a direction D3' of the bottom of the distribution chute 6, the direction D3' being positioned at an inclination angle A3 relative to the distribution chute center axis D3.

The holder 5 is rotated relative to the rotor 4 around the adjustment axis D2, as described in detail later. With such a rotation of the holder 5 relative to the rotor 4, the distribution chute center axis D3 is rotated around the adjustment axis D2 while keeping the second angle A2 relative to the adjustment axis D2. With this rotation, a point P at the opening of the tip of the distribution chute 6 rotates along a locus L2 of FIG. 1.

With this rotation, the angle of the distribution chute center axis D3 relative to the rotation axis D1 (i.e., the direction relative to the frame 3) is changed. Specifically, the center axis D3 swings leftwards from the position of the chain line indicated in FIG. 1 around the intersection point O.

The holder 5 and the rotor 4 are rotated around the rotation axis D1 against the frame 3, as described in detail later. With this rotation of the rotor 4 and the holder 5, the point P at the tip of the distribution chute 6 is rotated along the locus L1. In FIG. 1, the distribution chute center axis D3 forms the maximum angle relative to the rotation axis D1, in which the locus L1 is the largest. Here, by rotating the holder 5 against the rotor 4, i.e., rotating the distribution chute center axis D3 around the adjustment axis D2, the angle of the distribution chute center axis D3 relative to the center axis D1 becomes smaller, whereby the locus L1 gradually becomes smaller. Thus, the rotational distribution of material and the adjustment of the distribution radius are made possible.

In the exemplary embodiment, the first angle A1 at which the rotation axis D1 and the adjustment axis D2 intersect with each other is defined as, for instance, 20 degrees. The second angle A2 at which the adjustment axis D2 and the distribution chute center axis D3 intersect with each other is defined as, for instance, 20 degrees. In short, the second angle A2 is the same as the first angle A1. With this arrangement, when the holder 5 rotates and the distribution chute center axis D3 comes to the far left side in FIG. 1, the distribution chute center axis D3 coincides with the center axis D1, whereby the radius of the locus L1 becomes 0.

With reference to the above rotation axis D1, the adjustment axis D2 and the distribution chute center axis D3, the frame 3, the rotor 4, the holder 5 and the distribution chute 6 as well as drive mechanisms thereof will be described below.

In FIGS. 1 and 2, the frame 3 includes a flat cylindrical casing 30, an upper plate 31 covering an upper surface of the casing 30, and a lower plate 32 covering a lower surface of the casing 30. A feed pipe 33 is provided at the center of the upper plate 31. Material fed from the feed pipe 33 is transferred to the distribution chute 6 and is discharged from the distribution chute 6 into the blast furnace 2. An opening 34 is formed at the center of the lower plate 32. The rotor 4 is held in the opening 34. Each of the above components of the frame 3 is symmetrically formed around the rotation axis D1.

In FIGS. 1 and 2, the rotor 4 includes an upper casing 41 having a cylindrical portion surrounding the feed pipe 33, a lower casing 42 connected to a lower side of the upper casing 41 and housing the holder 5, and a mount 43 connected to an upper side of the upper casing 41 and supported by a rotation bearing 431.

Figure 3:
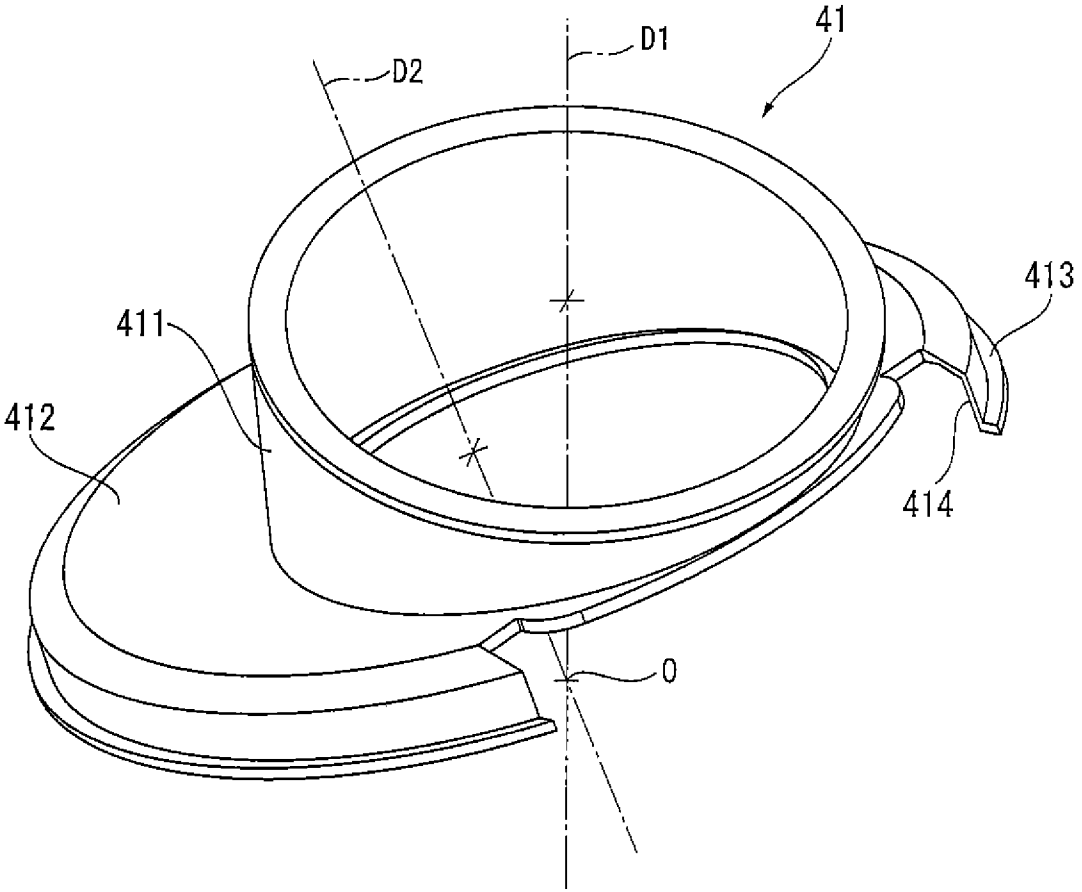
FIG. 3 is a perspective view showing an upper case of a rotor of the above exemplary embodiment.

In FIG. 3, the upper casing 41 includes a disc-shaped portion 412 at a lower end of a cylindrical portion 411 which surrounds the feed pipe 33. The center axis of the cylindrical portion 411 is the rotation axis D1. The center axis of the disc-shaped portion 412 is the adjustment axis D2.

The circumference of the disc-shaped portion 412 is formed downward. The lower flange 413 is formed on the edge of the circumference.

Part of the edge of the disc-shaped portion 412, closest to the cylindrical portion 411, is cut out over a predetermined length in the circumferential direction so as to form a transmission opening 414.

Figure 4:
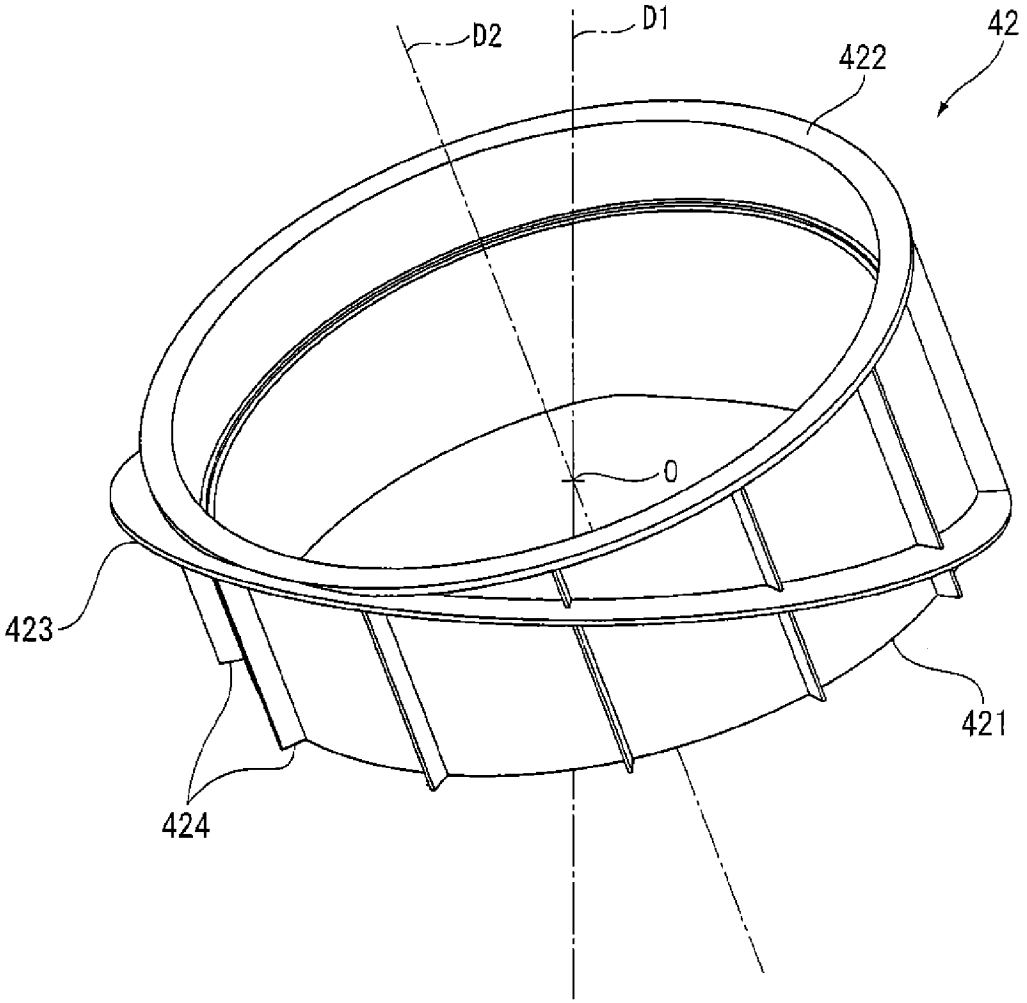
FIG. 4 is an upper-side perspective view showing a lower case of the rotor of the above exemplary embodiment.
Figure 5:
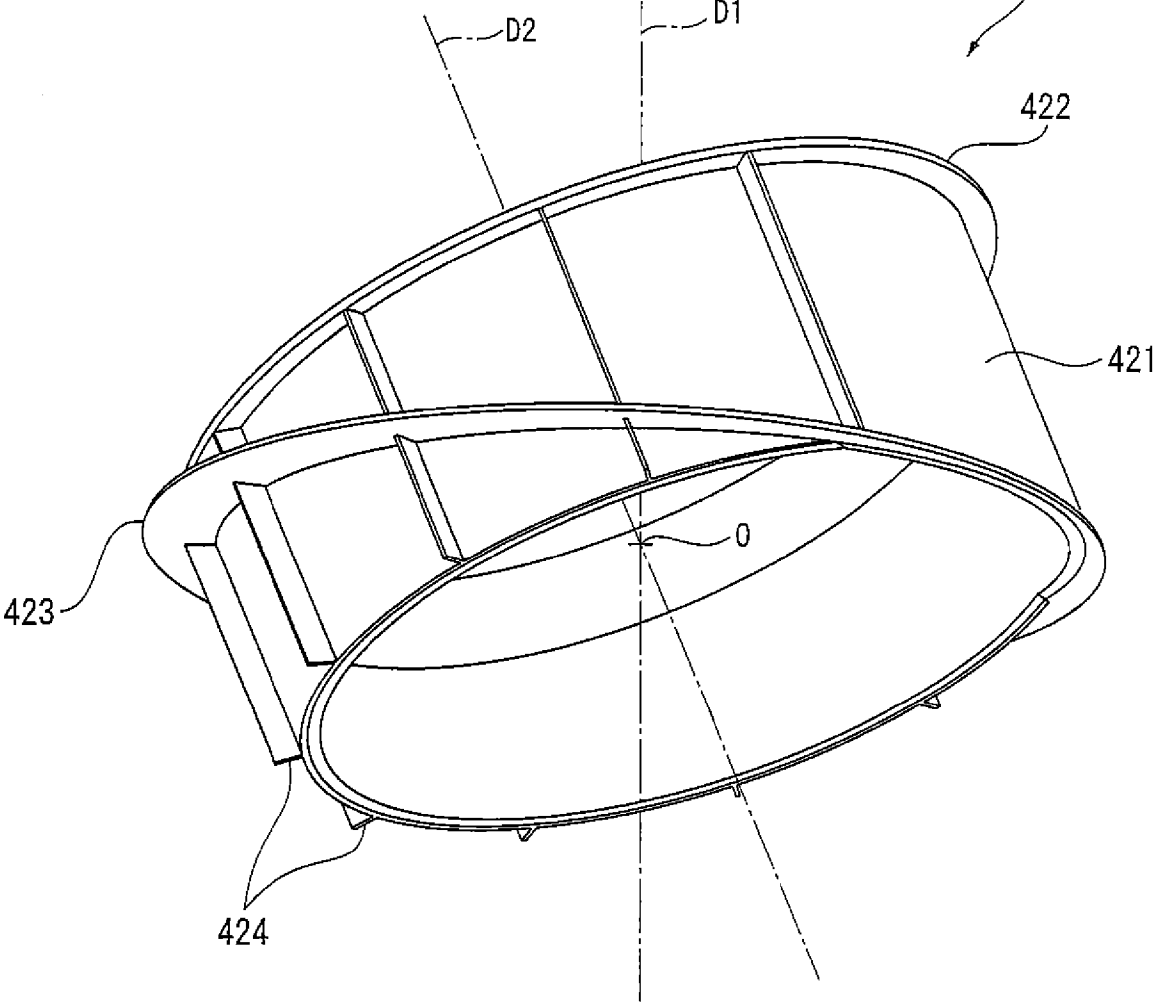
FIG. 5 is a lower-side perspective view showing the lower case of the rotor of the above exemplary embodiment.

In FIGS. 4 and 5, the lower casing 42 includes a cylindrical body 421, an upper flange 422 formed on an upper edge of the body 421, and a gas seal plate 423 formed on the circumference of the body 421.

The lower flange 413 of the upper casing 41 is connected to the upper flange 422, so that the upper opening of the body 421 is covered, and the inside of the body 421 is connected with the feed pipe 33 through the upper casing 41.

The gas seal plate 423 is formed on the body 421 in an inclined manner. This inclination of the gas seal plate 423 is determined such that the center axis of the gas seal plate 423 is aligned with the rotation axis D1 when the center axes of the body 421 and the upper flange 422 are aligned with the adjustment axis D2.

The circumference of the gas seal plate 423 is formed so as to fit the opening of the frame 3 and overlap with the opening 34 at a predetermined overlapping margin when the lower casing 42 is housed inside frame 3, thereby preventing gas in the blast furnace from entering a blast furnace top charging device. Moreover, with a packing and the like attached on this portion, gas sealing performance can be improved.

A plurality of reinforcing ribs 424 are formed on the circumference of the body 421 in the direction of the center axis of the body 421.

Referring to FIGS. 1 and 2, the mount 43 is connected to the upper side of the upper casing 41, supported by the rotation bearing 431, and rotatably supports the rotor 4 relative to the frame 3.

The rotation bearing 431 is fixed to the lower surface of the upper plate 31 of the frame 3 around the feed pipe 33, thereby rotatably supporting the entire rotor 4 around the rotation axis D1.

In FIGS. 1 and 2, the holder 5 is supported by the upper casing 41 of the rotor 4.

Figure 6:
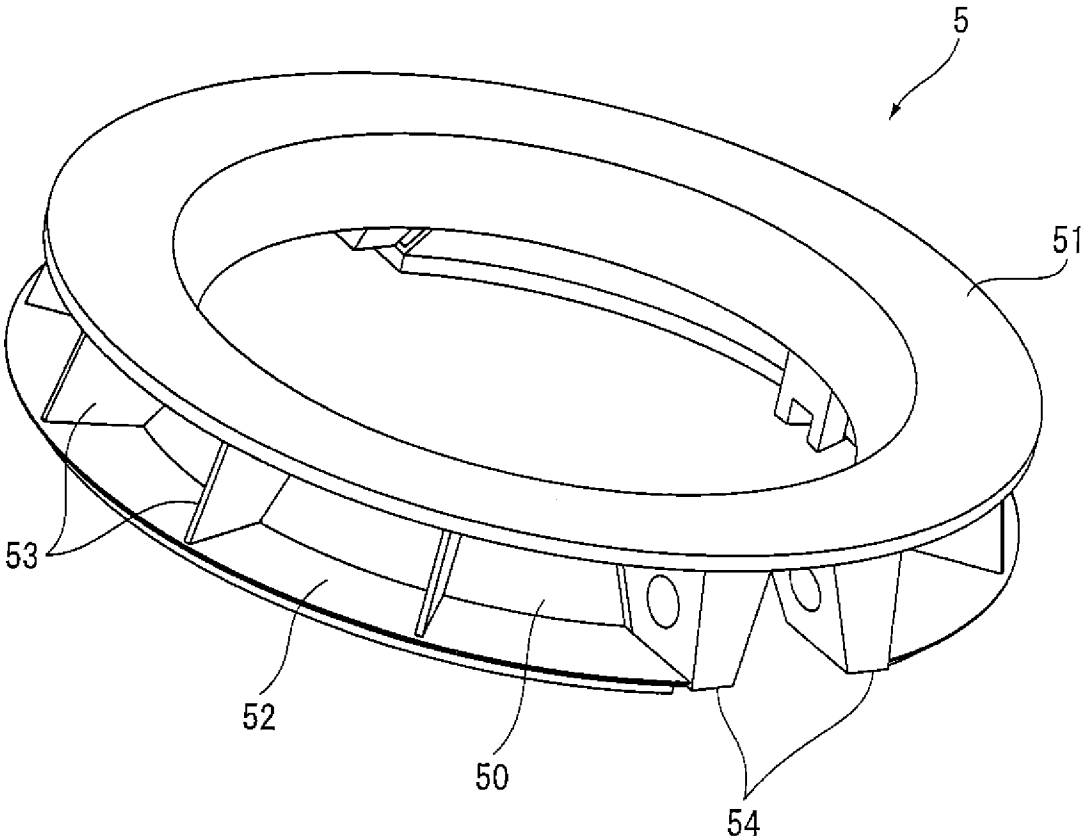
FIG. 6 is a perspective view showing a holder of the above exemplary embodiment.

In FIG. 6, the holder 5 includes a flat cylindrical body 50, in which an upper flange 51 and a lower flange 52 are respectively formed on upper and lower surroundings of the opening of the body 50, and reinforcing ribs 53 are formed on the circumference of the body 50 to bridge the upper flange 51 and the lower flange 52. Two cut-outs are formed in the body 50 and the lower flange 52. Receiving portions 54, through which distribution chute-fixing pins can be inserted, are formed along the cut-outs. In the exemplary embodiment, distribution chute-receiving portions of the distribution chute 6 are inserted inside receiving portions 54, and the distribution chute-fixing pins are inserted through the receiving portions 54, so that the distribution chute 6 is fixed to the holder 5 (see FIG. 7).

Referring to FIGS. 1 and 2, an adjustment bearing 55 is fixed to the inside of the rotor 4 (the lower side of the disc-shaped portion 412 of the upper casing 41 in FIG. 3). The holder 5 is supported by the adjustment bearing 55. With this arrangement, the holder 5 is rotatably supported around the adjustment axis D2 against the rotor 4.

In FIGS. 1 and 2, the adjustment bearing 55 is fixed to the lower side of the upper surface (the disc-shaped portion 412: see FIG. 3) of the upper casing 41. However, the adjustment bearing 55 may be fixed to the upper side thereof (see FIG. 17).

In FIGS. 1 and 2, the distribution chute 6 includes a cylindrical base end 60, a body 61 and a connecting body 62.

The upper end of the base end 60 is connected to the holder 5. The center axis of the base end 60 is aligned with the adjustment axis D2 in the same manner as that of the holder 5. The body 61 is connected to the lower end of the base end 60. The center axis of the body 61 is aligned with the distribution chute center axis D3. The base end 60 and the body 61 are connected to each other with the connecting body 62 that is formed as a dented portion because the body 61 and a lower plate 32 of the frame 3 interfere with each other.

Figure 7:
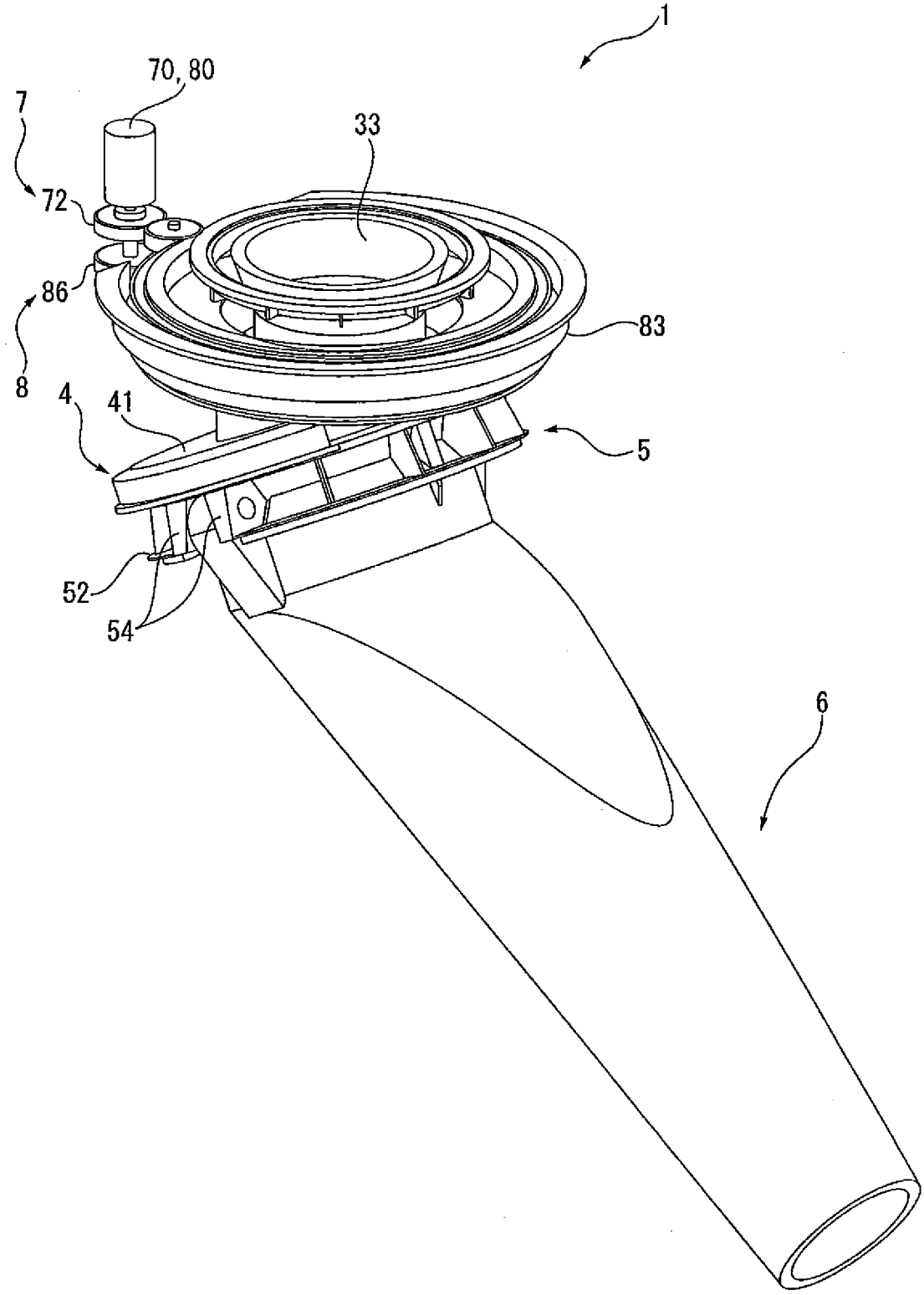
FIG. 7 is a perspective view showing the holder and a distribution chute of the above exemplary embodiment.

As shown in FIG. 7, the base end 60 of the distribution chute 6 is connected to the holder 5 and the holder 5 is housed in the rotor 4, whereby the tip of the feed pipe 33 is placed inside the base end 60. In such a state, when material is supplied from the feed pipe 33, the material passes through the distribution chute 6 and is discharged into the blast furnace 2 through the tip of the distribution chute 6. At this time, the direction in which the material is discharged into the blast furnace 2 is defined as the direction D3' of the bottom of the distribution chute 6. By adjusting the angle of the distribution chute 6, the charging pattern of the material distributed into the blast furnace 2 can be controlled.

More specifically, the material discharged into the blast furnace 2 is conveyed to the tip of the distribution chute 6 along the direction D3' of the bottom of the distribution chute 6. Accordingly, the direction in which the material is discharged into the blast furnace 2 is the direction of the inner surface of the distribution chute 6. Here, the angle formed by the center axis of the distribution chute 6 and the inner surface thereof is defined as the third angle A3. The first angle A1, the second angle A2 and the third angle A3 are set so that the sum of the abovementioned angles becomes the maximum inclination angle required for the distribution chute 6 (see FIG. 1).

In the charging device 1 of the exemplary embodiment, when the material is discharged from the distribution chute 6 as described above, the material is distributed into the blast furnace 2 in a ring shape having a predetermined radius by rotating the rotor 4 and the distribution chute 6 together. By rotating the rotor 4 and the holder 5 relatively to each other, the inclination angle of the distribution chute 6 relative to the rotation axis is adjusted to change the distribution radius. Accordingly, the material can be discharged over the entire area in the blast furnace 2.

For this purpose, the charging device 1 includes a rotation drive mechanism 7 that rotates the rotor 4 and an adjustment drive mechanism 8 that rotates the holder 5.

In FIGS. 1 and 2, a gear 71 is formed on the circumference of the rotation bearing 431. A gear 72 is meshed with the gear 71 and a gear 73 is meshed with the gear 72. The gear 73 is rotated by a rotation drive motor 70. The rotation drive motor 70 and the gears 71, 72 and 73 provide the rotation drive mechanism 7. It is also possible to rotate the gear 72 with the rotation drive motor 70, without using the gear 73.

A holder-side bevel gear 81 is formed on the circumference of the adjustment bearing 55. A transmission-side bevel gear 82 is meshed with the holder-side bevel gear 81.

The transmission-side bevel gear 82 is supported by an adjustment power transmission bearing 84 which is fixed to the frame 3 by a support member 83 extending from the lower surface of the upper plate 31 of the frame 3. The transmission-side bevel gear 82 is rotatable around the rotation axis D1. The holder-side bevel gear 81 is rotated together with the holder 5 around the adjustment axis D2. By using a bevel gear here, rotation power can be transmitted between the transmission-side bevel gear 82 and the holder-side bevel gear 81.

The holder-side bevel gear 81 is housed in the rotor 4 and the transmission-side bevel gear 82 is positioned outside of the rotor 4. However, since the transmission opening 414 is formed in the upper casing 41 of the rotor 4, the holder-side bevel gear 81 and the transmission-side bevel gear 82 are meshed through the transmission opening 414.

The holder-side bevel gear 81, the transmission-side bevel gear 82, and the transmission opening 414 provide an axial direction converting mechanism 9.

A gear 85 is formed on the circumference of the adjustment power transmission bearing 84. A gear 86 is meshed with the gear 85 and a gear 87 is meshed with the gear 86. The gear 87 is rotated by an adjustment drive motor 80. The adjustment drive motor 80, the holder-side bevel gear 81, the transmission-side bevel gear 82, and the gears 85, 86 and 87 provide the adjustment drive mechanism 8. It is also possible to rotate the gear 86 with the adjustment drive motor 80, without using the gear 87.

Figure 8:
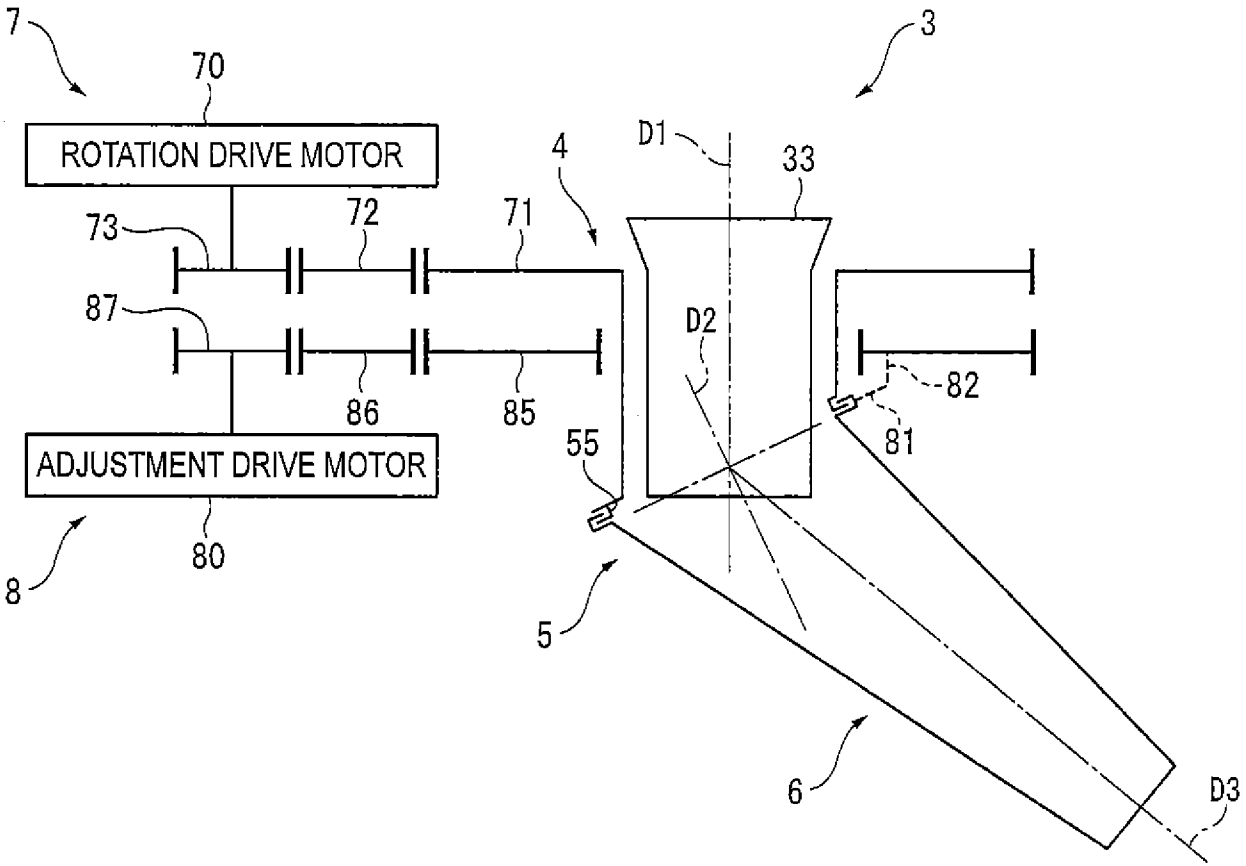
FIG. 8 is a schematic view showing a rotation drive mechanism and an adjustment drive mechanism of the above exemplary embodiment.

FIG. 8 schematically shows the driving force transmission path of the rotation drive mechanism 7 and the adjustment drive mechanism 8.

In the rotation drive mechanism 7, the driving force of the rotation drive motor 70 is transmitted to the gear 71 through the gears 73 and 72, thereby rotating the rotor 4 against the frame 3.

In the adjustment drive mechanism 8, the driving force of the adjustment drive motor 80 is transmitted to the gear 85 through the gears 87 and 86, thereby rotating the transmission-side bevel gear 82 against the frame 3. The driving force is transmitted from the transmission-side bevel gear 82 to the holder-side bevel gear 81, thereby rotating the holder 5 against the rotor 4.

When rotations of the rotation drive mechanism 7 and the adjustment drive mechanism 8 are synchronized and the rotation speed relative to the frame 3 of the rotor 4 and the rotation speed of the transmission-side bevel gear 82 are the same rotation speed, there is no relative rotation between the transmission-side bevel gear 82 and the holder-side bevel gear 81. As a result, the rotor 4 and the holder 5 rotate together and the distribution chute 6 rotates against the frame 3 without changing the angle of inclination.

On the contrary, by differentiating the rotation speeds of the rotation drive mechanism 7 and the adjustment drive mechanism 8 and creating a relative rotation between the rotor 4 and the holder 5, the angle of inclination of the distribution chute 6 is changed. In other words, while the relative rotation between the rotor 4 and the holder 5 is achieved by the adjustment bearing 55, the adjustment axis D2 centered in the adjustment bearing 55 is inclined relative to both the rotation axis D1 and the center axis D3 of the distribution chute 6. Thus, the distribution chute 6 rotates around the adjustment axis D2 in a swinging manner as a result of the relative rotation between the rotor 4 and the holder 5, whereby the inclination angle of the distribution chute 6 is adjusted.

In the charging device 1 according to the exemplary embodiment, by cooperative operation between the rotation drive mechanism 7 and the adjustment drive mechanism 8 as described above, the material is rotationally distributed around the rotation axis D1. By rotating the rotor 4 and the holder 5 relatively to each other around the adjustment axis D2, the angle of the distribution chute 6 is adjusted, thereby adjusting the distribution radius. The distribution rotations are repeated so as to form a plurality of concentric rings.

Figure 9:
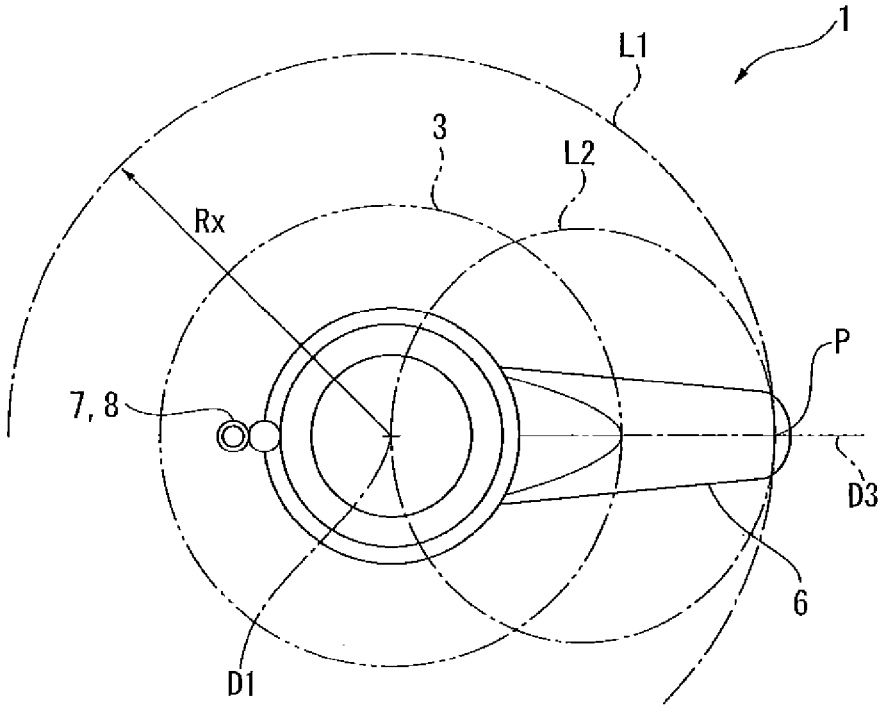
FIG. 9 is a plan view showing a rotation movement at the maximum distribution angle in the above exemplary embodiment.
Figure 10:
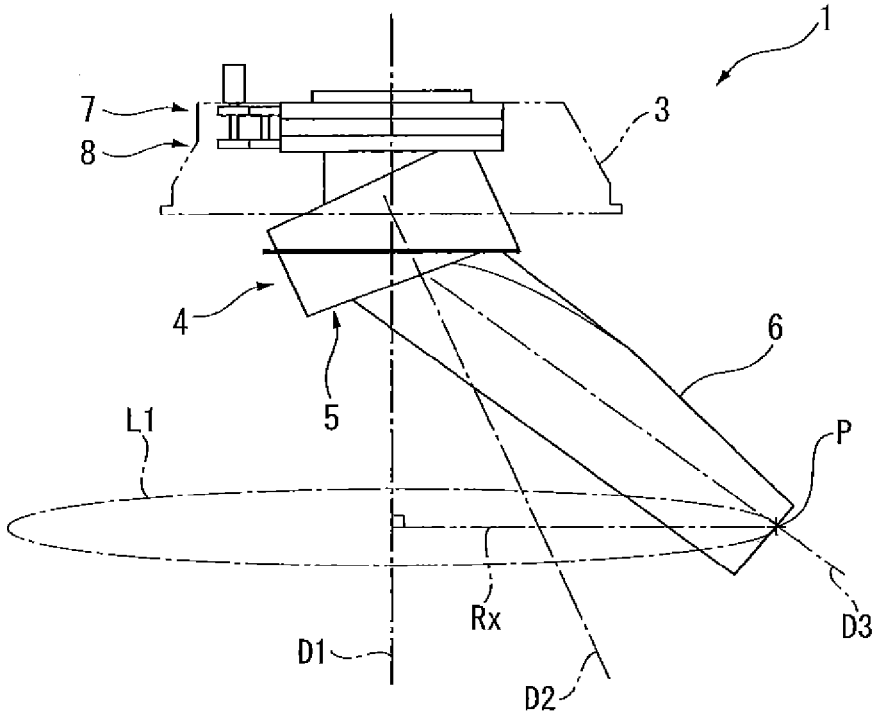
FIG. 10 is a lateral view showing the rotation movement at the maximum distribution angle in the above exemplary embodiment.

In FIGS. 9 and 10, the distribution chute 6 has the largest angle of inclination relative to the rotation axis D1 (an angle A1+A2), and a tip P of the distribution chute 6 is farthest from the rotation axis D1 (a radius Rx). Under such a state, when the rotor 4 and the holder 5 are rotated together, the tip P of the distribution chute 6 is rotated along the locus L1 with the radius Rx.

In order to rotate the rotor 4 and the holder 5 together, it is just necessary to synchronously control the rotation drive mechanism 7 and the adjustment drive mechanism 8 for rotating the rotor 4 and the transmission-side bevel gear 82 at the same rotation speed.

In order to rotate the holder 5 against the rotor 4, it is necessary to asynchronously control the rotation drive mechanism 7 and the adjustment drive mechanism 8. For instance, slowing the rotation speed of the transmission-side bevel gear 82 compared with that of the rotor 4, or temporarily stopping the transmission-side bevel gear 82. Also, the rotation speed of the transmission-side bevel gear 82 may be increased compared with that of the rotor 4.

Figure 11:
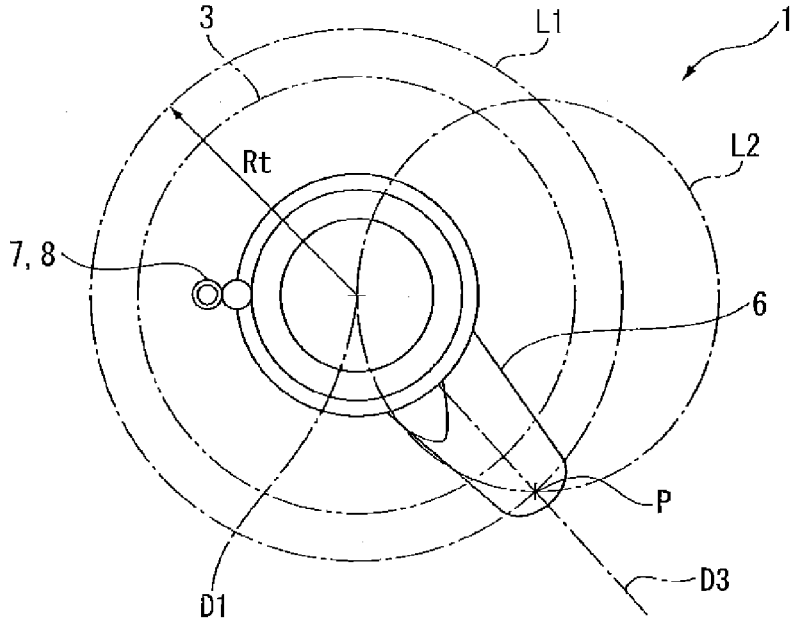
FIG. 11 is a plan view showing a rotation movement at an intermediate distribution angle in the above exemplary embodiment.
Figure 12:
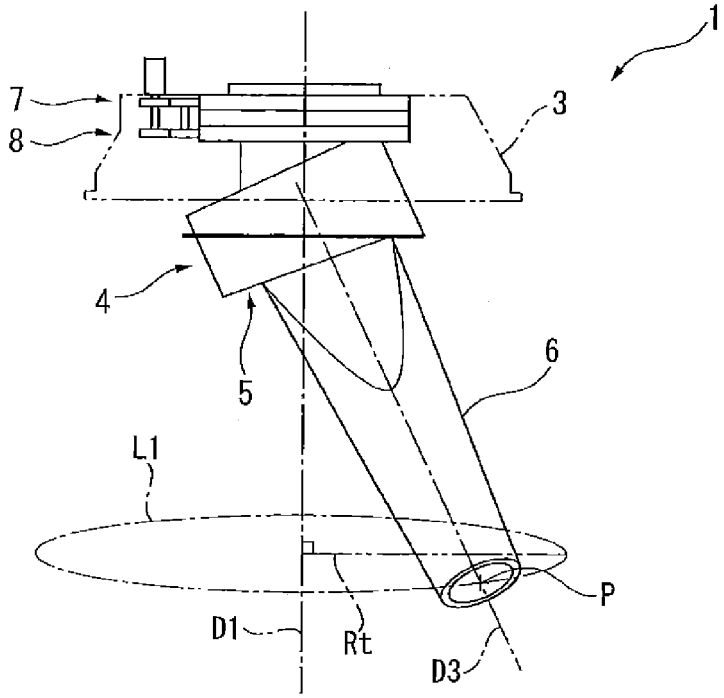
FIG. 12 is a lateral view showing the rotation movement at the intermediate distribution angle in the above exemplary embodiment.

In FIGS. 11 and 12, by moving the tip P of the distribution chute 6 along the locus L2 to decrease the inclination angle between the distribution chute 6 and the rotation axis D1, the distance (a radius Rt) between the tip P of the distribution chute 6 and the rotation axis D1 is decreased. Under such a state, by rotating the rotor 4 and the holder 5 together, the tip P of the distribution chute 6 is rotated along the locus L1 with the radius Rt.

Figure 13:
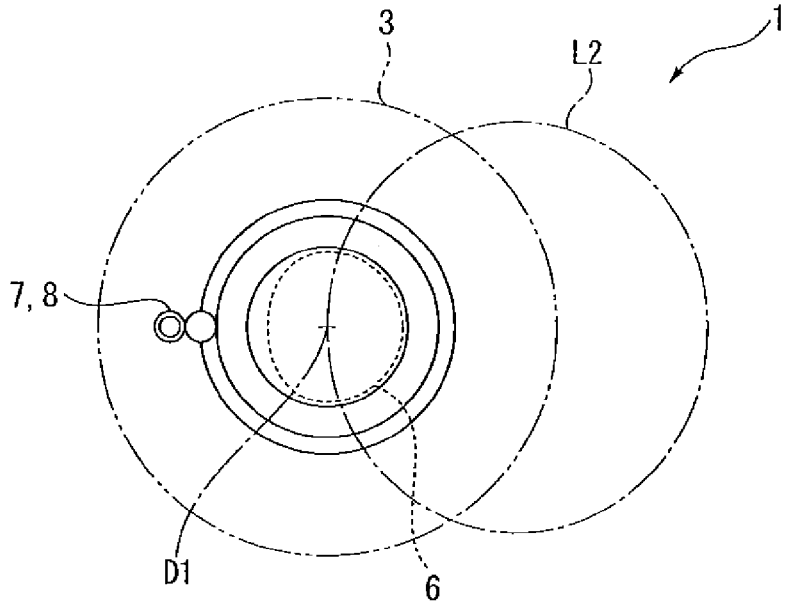
FIG. 13 is a plan view showing a rotation movement at the minimum distribution angle in the above exemplary embodiment.
Figure 14:
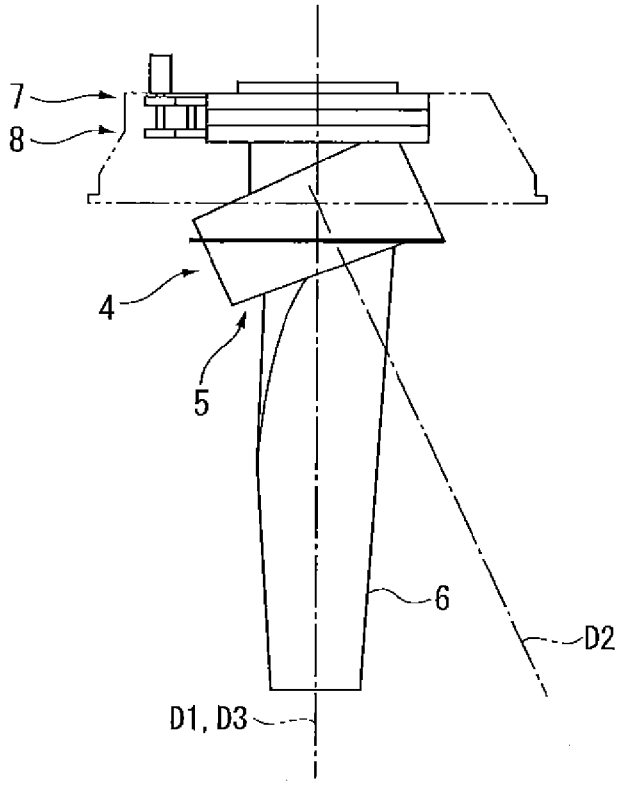
FIG. 14 is a lateral view showing the rotation movement at the minimum distribution angle in the above exemplary embodiment.

In FIGS. 13 and 14, by moving the tip P of the distribution chute 6 along the locus L2 to align the distribution chute 6 with the rotation axis D1, the inclination angle therebetween becomes 0 and the distance (radius) between the tip P of the distribution chute 6 and the rotation axis D1 also becomes 0. Under such a state, the tip P of the distribution chute 6 is rotated on the rotation axis D1.

Thus, since the rotation radius of the tip P of the distribution chute 6 can be adjusted, the distribution chute 6 can distribute the material with rotating in various radii. Accordingly, the material can be distributed uniformly or in other distribution patterns within the blast furnace 2.

Thus, in the exemplary embodiment, the rotation drive mechanism 7 and the adjustment drive mechanism 8 are cooperatively operated with each other to rotate the holder 5 and the rotor 4 together, thereby rotationally distributing the material. Simultaneously, by adjusting the relative angle between the holder 5 and the rotor 4 by the relative rotation therebetween, the angle of inclination of the distribution chute 6 relative to the rotation axis D1 is optionally adjustable, whereby the distribution radius with which the material is distributed within the blast furnace is freely adjustable.

In the exemplary embodiment, the inclination adjustment of the distribution chute 6 can be easily performed by switching the rotation status of the rotor 4 and the transmission-side bevel gear 82 from the synchronized rotation to the relative rotation through speed control of the rotation drive mechanism 7 and the adjustment drive mechanism 8.

In the exemplary embodiment, the inclination of the distribution chute 6 is adjusted by setting the inclinations with respect to the rotor 4, the holder 5 and the distribution chute 6 as described above (the first angle A1 between the rotation axis D1 and the adjustment axis D2, and the second angle A2 between the adjustment axis D2 and the distribution chute center axis D3). Accordingly, no complicated support mechanism related to rotation directions is necessary, and the structure is simple.

Particularly, since the rotation and angles are freely adjustable by speed control of the rotation drive mechanism 7 and the adjustment drive mechanism 8, various operations can be freely set depending on the design of the controller.

The scope of the invention is not limited to the above exemplary embodiment, but specific arrangement and the like may be altered as needed upon implementation.

In the above exemplary embodiment, as shown in FIG. 1 or FIG. 2, the rotation drive motor 70 and the adjustment drive motor 80 are set on the same axis. However, the rotation drive motor 70 and the adjustment drive motor 80 may be set on separate axes adjacent to each other, or may be set remotely from each other. Moreover, in the above exemplary embodiment, the driving of the rotor 4 by the rotation drive motor 70 and the driving of the holder 5 of the adjustment drive motor 80 are independent from each other to cause a phase difference in rotation between these systems through speed control of the motors. Instead of that, a planetary gear may be used for controlling such a phase difference.

Figure 15:
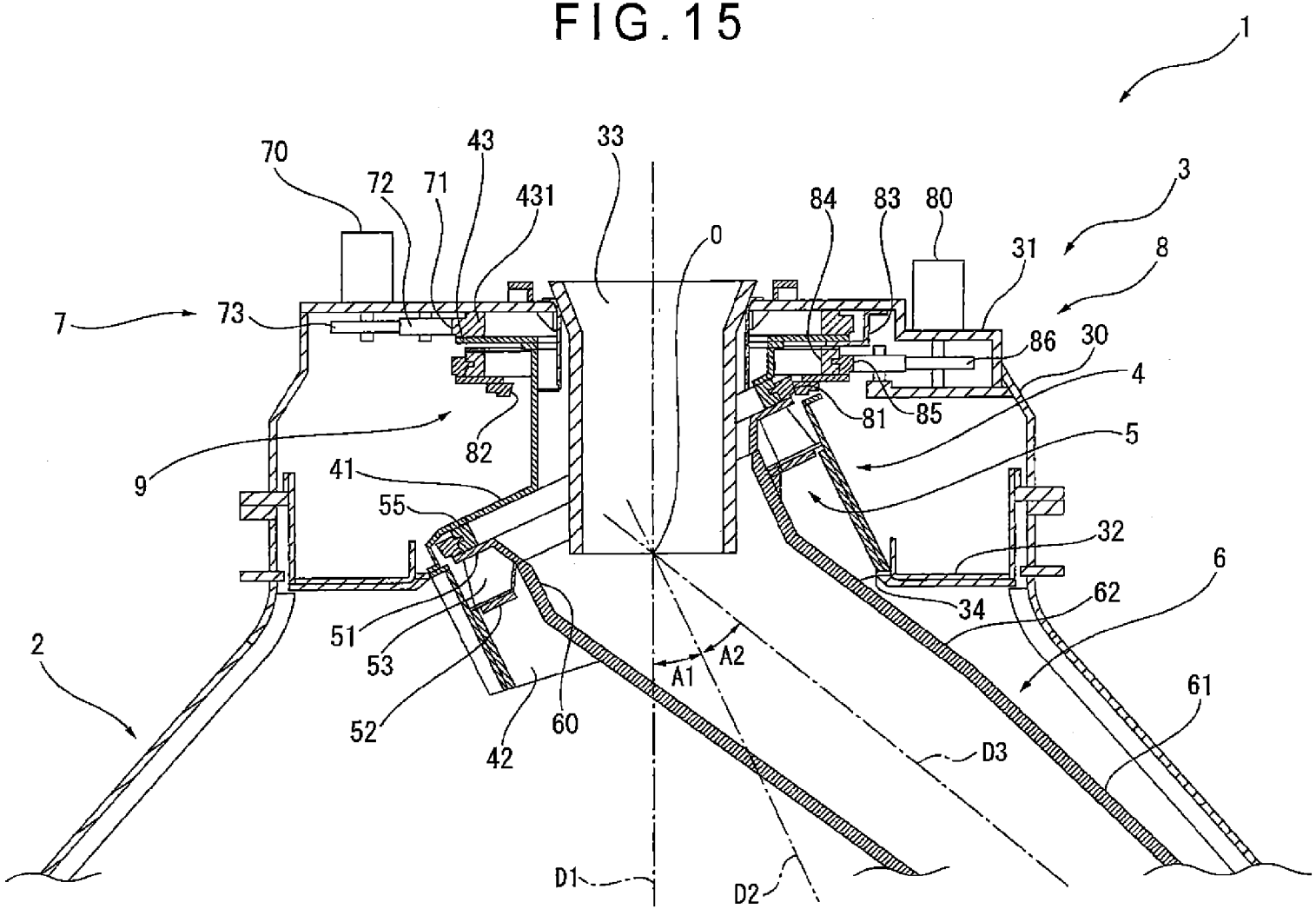
FIG. 15 is a vertical cross-sectional view showing another exemplary embodiment of the invention.

FIG. 15 shows another exemplary embodiment of the invention. In the exemplary embodiment, the rotation drive motor 70 and the adjustment drive motor 80 are separately set on the upper plate 31 of the casing 30. As a transmitter of a driving force from each of the motors, a transmission mechanism including the same gear train as that in the exemplary embodiment in FIG. 1 as described above is set. With this arrangement, the rotation drive mechanism 7 and the adjustment drive mechanism 8 are independently provided.

According to this exemplary embodiment, the same advantages as those of the exemplary embodiment in FIG. 1 as described above can be obtained.

Further, the rotation drive motor 70 and the adjustment drive motor 80 are positioned opposing each other across the rotation axis D1. However, the rotation drive motor 70 and the adjustment drive motor 80 may be disposed anywhere on a circumference around the rotation axis D1.

Figure 16:
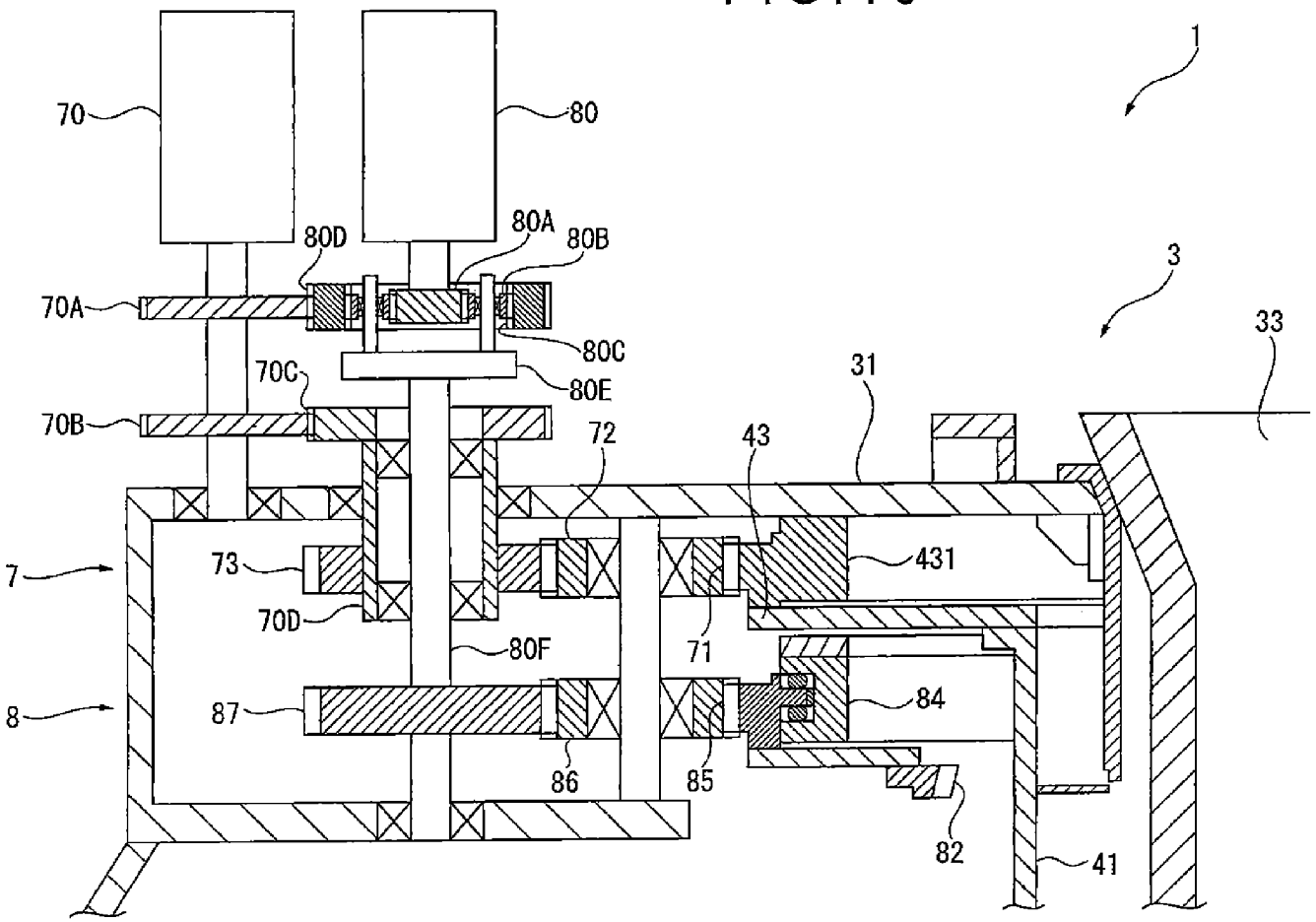
FIG. 16 is a vertical cross-sectional view showing still another exemplary embodiment of the invention.

FIG. 16 shows still another exemplary embodiment of the invention. In the exemplary embodiment, the rotation drive motor 70 and the adjustment drive motor 80 are related to each other by using a planetary gear.

Gears 70A and 70B are fixed to an output axis of the rotation drive motor 70, in which the gear 70B is meshed with a gear 70C to drive the gear 73 through a cylindrical shaft 70D. A driving path from the gear 73 to the rotor 4 is the same as that of the exemplary embodiment in FIG. 1 as described above.

The adjustment drive motor 80 is juxtaposed to the rotation drive motor 70. A gear 80A is fixed to the output axis of the adjustment drive motor 80. A plurality of planet gears 80B are disposed around the gear 80A. Each of the planet gears 80B is meshed to an inner gear 80C at the outside thereof. A gear 80D is formed on the circumference of the cylindrical member that is provided with the inner gear 80C. The gear 80D is meshed with the gear 70A. The rotation axis of the planetary gears 80B is supported by a rotary plate 80E, of which a center axis 80F is fixed to the gear 87. The driving path from the gear 87 to the transmission-side bevel gear 82 is the same as that of the exemplary embodiment in FIG. 1 as described above.

In this exemplary embodiment, by activating the rotation drive motor 70 while the adjustment drive motor 80 is stopped, the rotor 4 is rotated by the rotation drive mechanism 7. Simultaneously, the rotation is also transmitted to the adjustment drive mechanism 8 through the planetary gears 80B, thereby rotating the holder 5 and the distribution chute 6. On the other hand, when the adjustment drive motor 80 is activated, the rotation causes a phase difference in rotation between the rotor 4 and the distribution chute 6, thereby adjusting the inclination angle of the distribution chute 6.

According to this exemplary embodiment, the same advantages as those of the exemplary embodiment in FIG. 1 as described above can also be obtained.

In the exemplary embodiment in FIG. 1 as described above, the holder-side bevel gear 81 is defined as an outer gear and the transmission-side bevel gear 82 is defined as an inner gear. However, the holder-side bevel gear 81 and the transmission-side bevel gear 82 may be different gears.

Figure 17:
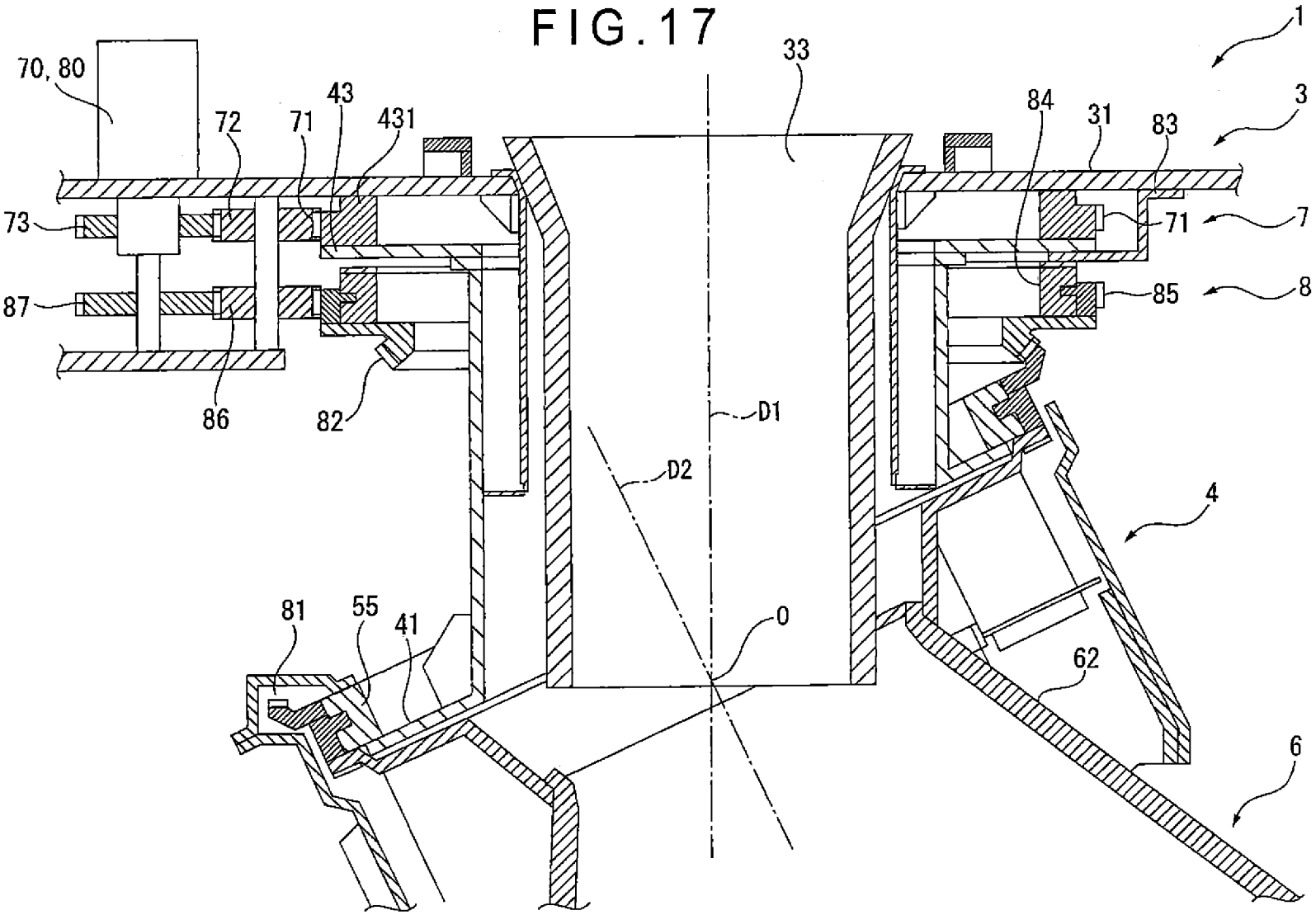
FIG. 17 is a vertical cross-sectional view showing a further exemplary embodiment of the invention.

FIG. 17 shows a further exemplary embodiment of the invention. In the exemplary embodiment, the holder-side bevel gear 81 is defined as an inner gear and the transmission-side bevel gear 82 is defined as an outer gear. Components other than the above are the same as those of the exemplary embodiment in FIG. 1 as described above.

According to this exemplary embodiment, the same advantages as those of the exemplary embodiment in FIG. 1 as described above can also be obtained.

Specific arrangement of the exemplary embodiments as described above may be altered as needed. Any arrangement is applicable to the invention as long as the arrangement can achieve the above-described inclination setting (the first angle A1 between the rotation axis D1 and the adjustment axis D2, and the second angle A2 between the adjustment axis D2 and the distribution chute center axis D3).

Figure 18:
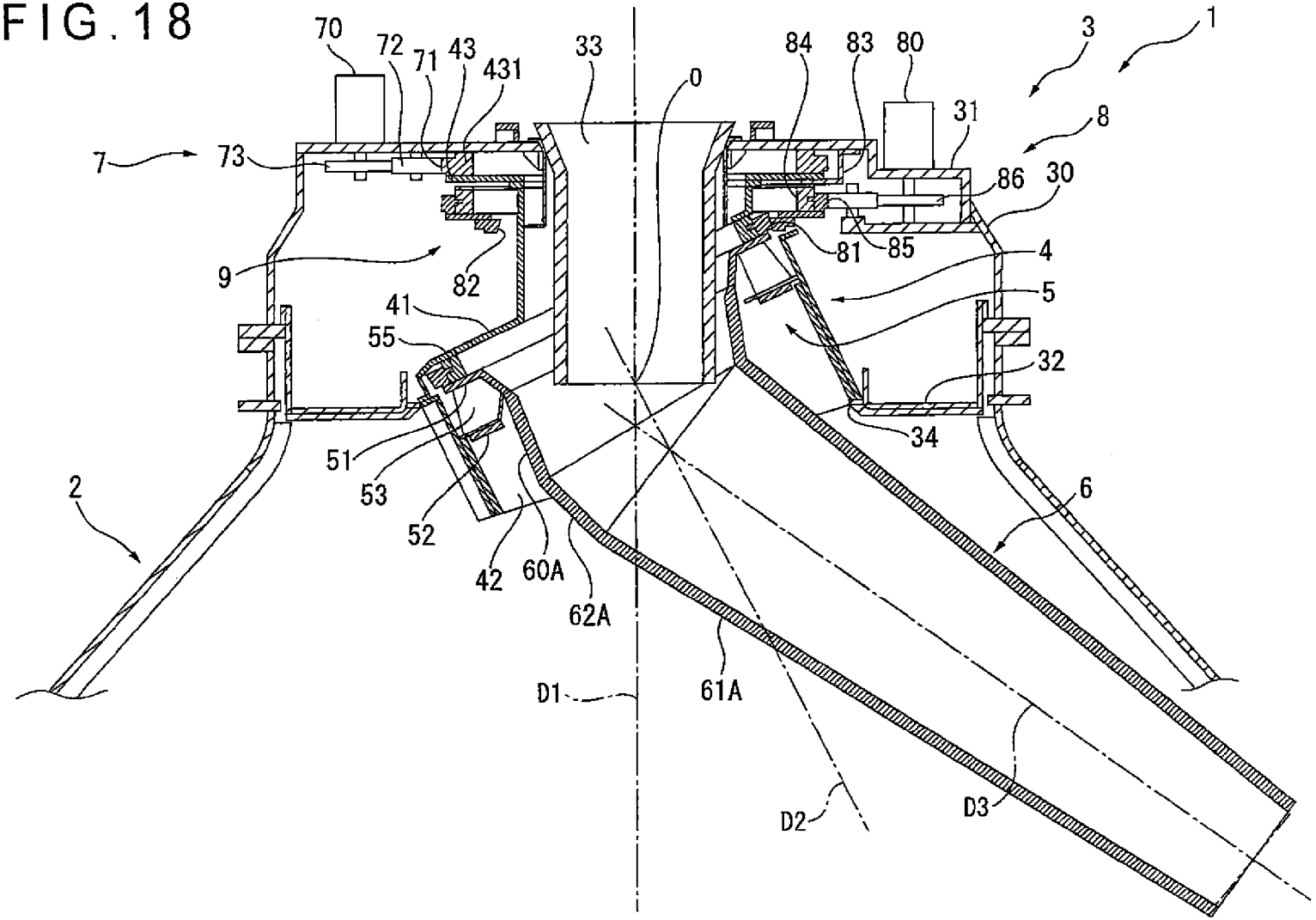
FIG. 18 is a vertical cross-sectional view showing the maximum distribution angle of the distribution chute in a still further exemplary embodiment of the invention.
Figure 19:
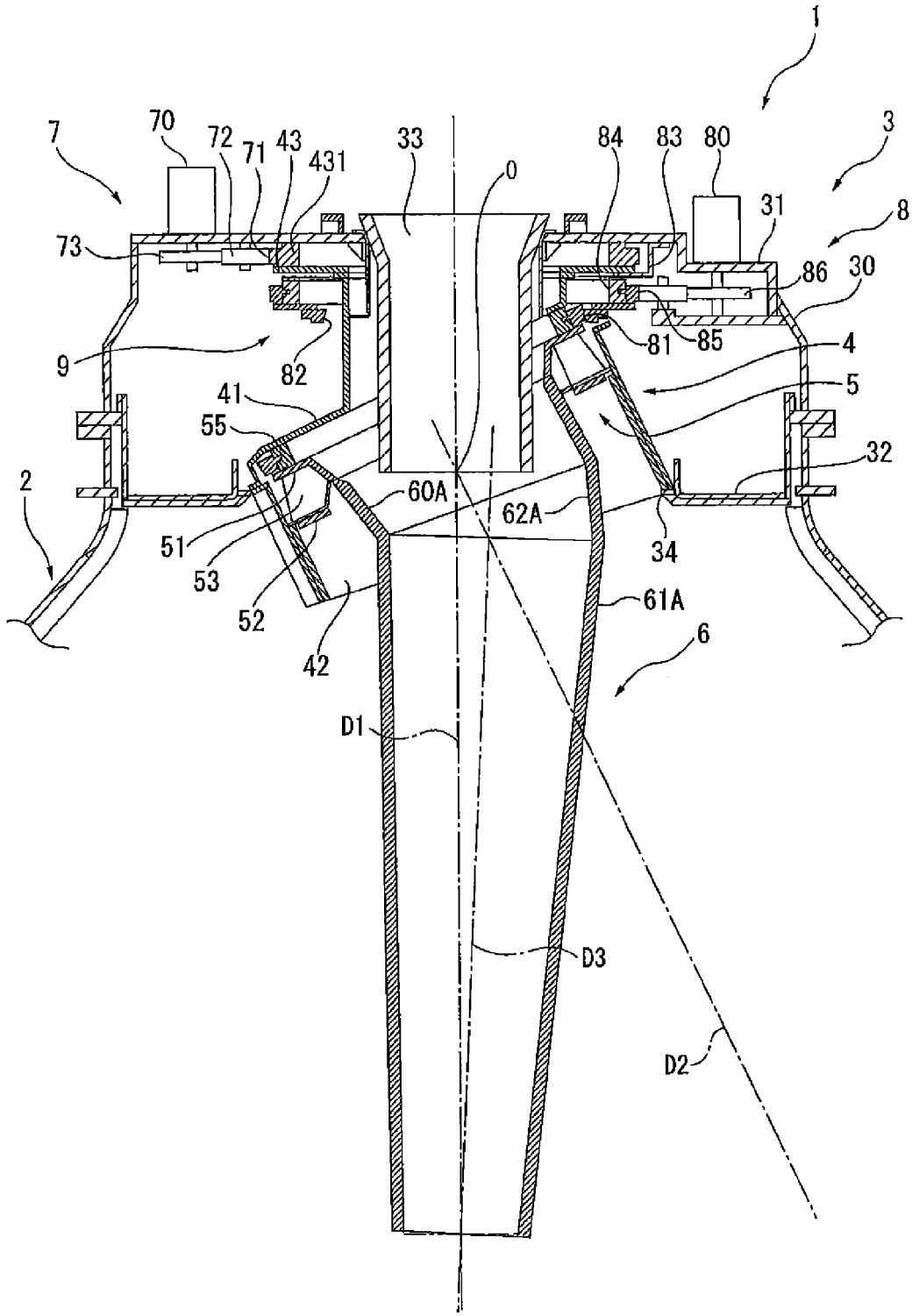
FIG. 19 is a vertical cross-sectional view showing the minimum distribution angle of the distribution chute in the exemplary embodiment of the invention shown in FIG. 18.

FIGS. 18 and 19 show a still further exemplary embodiment of the invention.

In each of the above exemplary embodiments, three axes of the rotation axis D1, the adjustment axis D2 and the distribution chute center axis D3 are mutually intersected at the intersection point O. Moreover, in order that the body 61 of the distribution chute 6 does not interfere with the lower surface 32 of the frame, the body 61 is connected with the connecting body 62 provided by denting the body 61, which provides a concave clearance shape at a part of the distribution chute 6.

On the contrary, in this exemplary embodiment, a body 61A, an intermediate portion 62A and a base end 60A are connected to form the distribution chute 6. The body 61A is a tapered cylinder of which a diameter gradually becomes smaller. The intermediate portion 62A has a gradually changing center axis such that the center axis of a base part thereof connecting to the base end 60A coincides with a center axis of a tip of the base end 60A. The base end 60A has a gradually changing center axis such that the center axis of a base part thereof connecting to the holder 5 coincides with the adjustment axis D2. The body 61A, the intermediate portion 62A and the base end 60A are connected to form the distribution chute 6. Although the center axis of the cross section of a base part of the base end 60A coincides with adjustment axis D2 and the distribution chute center axis D3 passing through the center of the body 61A intersects with the adjustment axis D2, the intersection therebetween is different from the intersection O between the rotation axis D1 and the adjustment axis D2.

According to the exemplary embodiment, the maximum distribution radius can also be obtained at the maximum inclination angle as shown in FIG. 18. The minimum distribution radius can also be obtained at the minimum inclination angle, i.e., in a vertically downward orientation, as shown in FIG. 19. The base end 60A, the intermediate portion 62A and the body 61A are curved downward as a whole, which prevents interference with the lower surface 34 of the frame. Moreover, since the cross sections of the base end 60A, the intermediate portion 62A and the body 61A are circular, even when the distribution chute 6 is oriented in different directions for inclination adjustment, the cross section of the distribution chute 6 is constantly circular to cause no effect on the material passing therethrough.

The invention claimed is:

1. A charging device comprising:

a frame;

a rotation axis set in the frame;

a rotor supported by the frame and being rotatable around the rotation axis;

an adjustment axis set in the rotor and intersecting with the rotation axis at a first angle;

a holder supported by the rotor and being rotatable around the adjustment axis;

a distribution chute fixed to the holder with a center axis of the distribution chute extending in a direction intersecting with the adjustment axis at a second angle, the distribution chute being rotatable around the adjustment axis with a rotation of the holder while the center axis of the distribution chute maintains the second angle relative to the adjustment axis;

a rotation drive motor fixed to the frame and being configured to rotate the rotor against the frame;

a transmission-side bevel gear supported by the frame and being rotatable around the rotation axis;

a holder-side bevel gear fixed to the holder and being meshed with the transmission-side bevel gear; and an adjustment drive motor fixed to the frame and being configured to rotate the holder against the rotor by rotating the transmission-side bevel gear.

2. The charging device according to claim 1, wherein the first angle is equal to the second angle.

3. The charging device according to claim 1, wherein the angle formed by the center axis of the distribution chute and an inner surface of the distribution chute is defined as a third angle, and a sum of the first angle, the second angle and the third angle is set at a maximum inclination angle required for the distribution chute.

4. The charging device according to claim 2, wherein the angle formed by the center axis of the distribution chute and an inner surface of the distribution chute is defined as a third angle, and a sum of the first angle, the second angle and the third angle is set at a maximum inclination angle required for the distribution chute.

5. The charging device according to claim 1, wherein when a rotation speed of the rotor and a rotation speed of the transmission-side bevel gear are equal, the rotor, the holder, and the distribution chute will rotate such that the angle of the distribution chute with respect to the rotation axis remains constant.

6. The charging device according to claim 1, wherein when a rotation speed of the rotor and a rotation speed of the transmission-side bevel gear are not equal, the rotor, the holder, and the distribution chute will rotate such that the angle of the distribution chute with respect to the rotation axis changes.

* * * * *